United States Patent [19]

Reichardt et al.

[11] Patent Number: 4,536,045

[45] Date of Patent: Aug. 20, 1985

[54] PLUG CONNECTION

[75] Inventors: Manfred Reichardt, Weinberg; Günter Schützle, Heilbronn, both of Fed. Rep. of Germany

[73] Assignee: Allied Corporation, Morris Township, Morris County, N.J.

[21] Appl. No.: 457,315

[22] Filed: Jan. 11, 1983

[30] Foreign Application Priority Data

Jan. 15, 1982 [DE] Fed. Rep. of Germany ..... 3201142

[51] Int. Cl.[3] ..... H01R 4/66

[52] U.S. Cl. ..... 339/14 P; 339/143 R; 339/176 MF; 339/136 R

[58] Field of Search ..... 339/143, 147, 14, 177, 339/176 MF, 17 F, 136 R

[56] References Cited

U.S. PATENT DOCUMENTS

| | | | |
|---|---|---|---|
| 3,509,513 | 4/1970 | Russin | 339/14 R |
| 3,513,433 | 5/1970 | Carroll | 339/14 R |
| 3,573,704 | 4/1971 | Tarver | 339/14 R |
| 3,670,293 | 6/1972 | Garver | 339/143 R |
| 3,691,509 | 9/1972 | Krol | 339/14 R |
| 3,696,319 | 10/1972 | Olsson | 339/17 F |
| 3,745,509 | 7/1973 | Woodward et al. | 339/14 R |
| 3,777,050 | 12/1973 | Silva | 174/78 |
| 3,808,353 | 4/1974 | Burtelson | 174/92 |
| 3,824,529 | 7/1974 | Dorrell | 339/99 R |
| 3,842,390 | 10/1974 | Glover et al. | 339/14 R |
| 3,904,261 | 9/1975 | Cooney | 339/17 F |
| 3,958,851 | 5/1976 | Evans | 339/177 E |
| 3,977,755 | 8/1976 | Edel et al. | 339/143 R |
| 4,010,538 | 3/1977 | O'Keefe et al. | 339/177 E |
| 4,022,966 | 5/1977 | Gajajiva | 174/65 SS |
| 4,080,024 | 3/1978 | Kroon | 339/14 R |
| 4,130,334 | 12/1978 | Anderson | 339/103 M |
| 4,130,934 | 12/1978 | Asick et al. | 29/628 |
| 4,195,272 | 3/1980 | Boutros | 333/182 |
| 4,195,893 | 4/1980 | Stupay | 339/14 R |
| 4,252,393 | 2/1981 | Johnson | 339/75 MP |
| 4,265,505 | 5/1981 | Bourdon | 339/99 R |
| 4,273,405 | 6/1981 | Law | 339/14 R |
| 4,377,320 | 3/1983 | Lathrop et al. | 339/177 R |
| 4,381,129 | 4/1983 | Krenz | 339/143 R |
| 4,422,787 | 12/1983 | Wada et al. | 339/143 R |

FOREIGN PATENT DOCUMENTS

| | | |
|---|---|---|
| 828789 | 3/1957 | United Kingdom . |
| 2020494A | 4/1979 | United Kingdom . |
| 2056194A | 8/1980 | United Kingdom . |
| 2048583A | 12/1980 | United Kingdom . |
| 2105925A | 7/1982 | United Kingdom . |

*Primary Examiner*—Gil Weidenfeld
*Assistant Examiner*—David L. Pirlot
*Attorney, Agent, or Firm*—Roger H. Criss; Roy H. Massengill

[57] ABSTRACT

A plug connection for a shielded flat or round cable. A shielded connecting element (80,85) is connected in one piece with the cable shielding (91,95). The shielding connector element includes a housing contact part (70,86) which is in contact with a part lying on the ground or reference potential. The shielded connecting element (80) for the flat cable (3) extends between the cable core (92) and the cable shielding (91) and is in connection with the ground or reference potential. The housing contact part (86) for the round cable (30) is spring-loaded on the inside wall of housing (1).

10 Claims, 10 Drawing Figures

PLUG CONNECTION

BACKGROUND OF THE INVENTION

1. Field of the Invention

The invention refers to an arrangement for shielding a plug connection against electromagnetic radiations.

2. Description of the Prior Art

It is known to be frequently necessary to shield signal cables against electromagnetic radiations. For this purpose, the cables leading to the plug connection are provided with a metallic shield, which is connected electrically conductive over the plug connection, for example, with the housing of a piece of equipment.

For shielding the plug connection, it is known how to equip the housing wall of a plug connection provided with a plastic housing with a metal covering, which on the one hand is connected with the cable shield and on the other hand is connected with the ground potential over the front surface of the plug.

Other pin contacts can be provided between the pin contacts of a plug board in order to shield a plug connector, which are connected with the cable shield over a shielding piece of sheet metal and a clamp.

Furthermore, it is already known to provide a large number of contact springs in connection with the plug connection, which connect a housing wall of one piece of equipment in an electrically conductive manner with non-protruding parts of the front surface of the plug connector housing. Plug connections for a shielded flat cable, especially a flat cable of the design in the case of which a metal foil surrounds the cable core exhibiting several wires lying next to each other, are known. The cable core is connected to the plug connector preferably by insulation-free cutting clamp connections (insulation intersecting technique).

Many problems occur in the case of the known plug connections for flat cables. For example, the cable shielding of the flat cable must in some manner be brought into connection with a ground or reference potential. This is either very difficult according to the used type of flat cable and necessitates expensive equipment, or a long period of time is necessary, for example, the latter is the case when a supplementary ground wire must be connected, which is provided together with the cable shield in the flat cable.

It would be desirable to provide a plug connection in such a manner that an excellent shielding of the plug is achieved in a simple, economical manner.

SUMMARY OF THE INVENTION

In accordance with this invention, there is provided a plug connection for a shielded cable characterized by the fact that a shielded connecting element is connected in one piece with the cable shielding and that the shielded connecting element includes a housing contact part which lies in contact with a part lying on the ground potential or the reference potential.

According to a first aspect, the invention provides a plug connection for a shielded flat cable in such a way that the disadvantages of the state of the art are avoided, whereby especially a simple and sure contacting is to be achieved with the cable shielding. Furthermore, the invention provides a plug connection for a shielded flat cable in such a way that a large surface connection of the cable shielding is achieved, whereby furthermore, by including the plug connection housing in the shielding system, disturbing influences at the transition from the shielded flat cable to the plug connection and from there to the counter plug connection are avoided. Furthermore, the invention provides a cost-effective shielding in the area of the transition from the plug connector to the counter plug connection.

According to another aspect of the invention, a shielding connecting element is provided for plug connectors generally and especially also for round cable plug connections, which exhibits a spring-loaded contact organ for contacting with a party lying on the reference potential.

DESCRIPTION OF THE PREFERRED EMBODIMENTS

Figure 10:
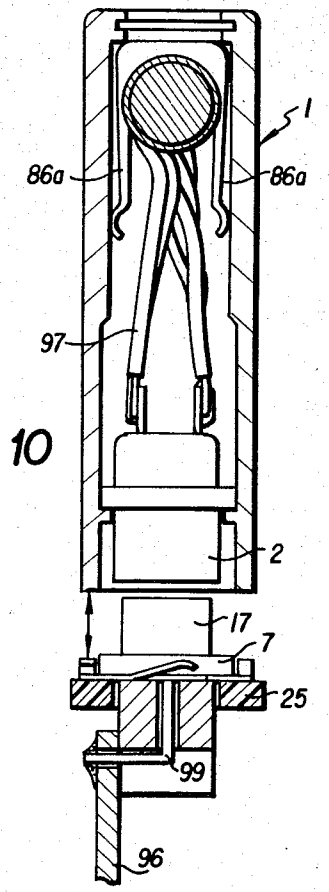
FIG. 10 shows a cross-section along line A-B through the plug connection of FIG. 9.
Figure 8:
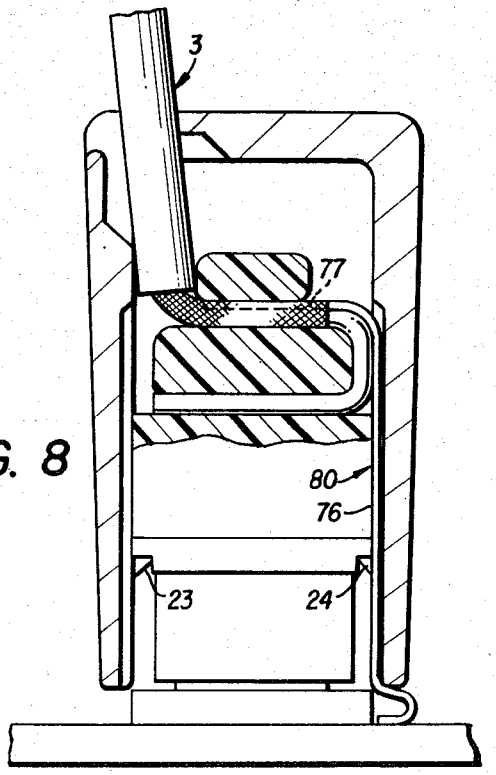
FIG. 8 shows a third embodiment of a plug connection according to the invention in a sectional representation similar to FIG. 2.
Figure 9:
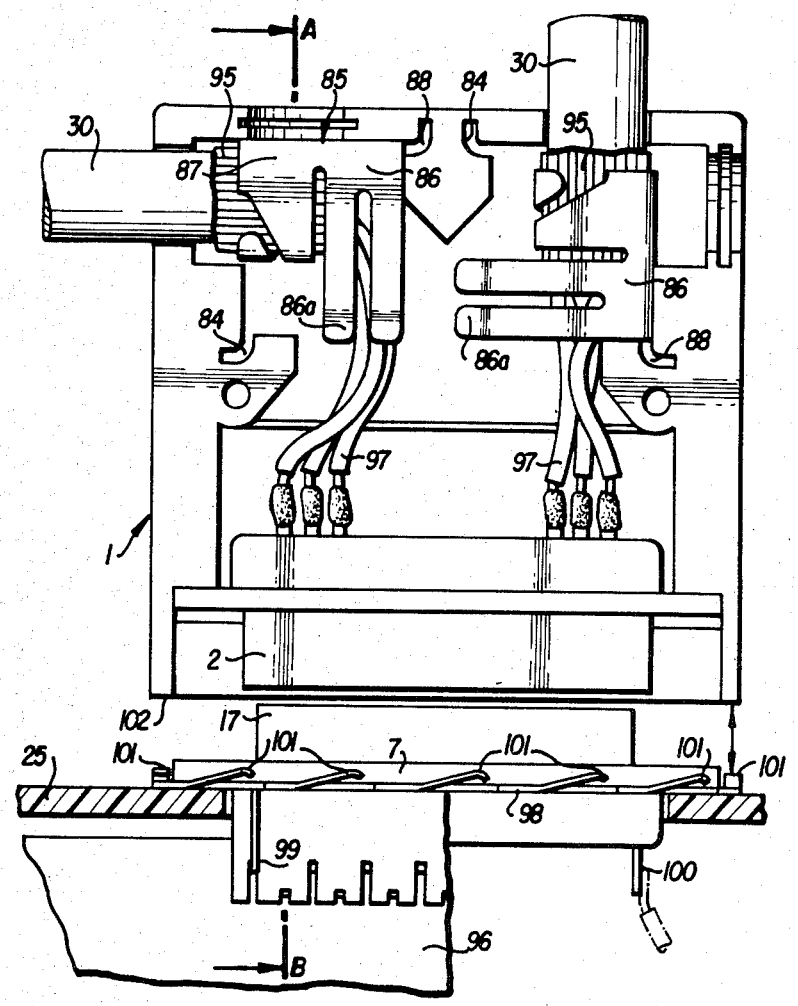
FIG. 9 shows a schematic longitudinal cross-section through a round cable plug connection, whereby two alternative connection types are shown for the round cable.

In the following, several embodiments of the invention are described. These embodiments include plug connections for shielded flat cable (FIGS. 1–8) and plug connections for shielded round cable (FIGS. 9 and 10).

With the embodiments of both types of cable, a shielding connecting element is used, preferably a piece of shielding sheet metal (80;81), which on the one hand is brought into contact with the cable shielding and on the other hand is in contact with a part lying on the ground or reference potential—preferably by spring force, so that a good grounding of the cable shielding takes place in a simple manner.

Figure 3:
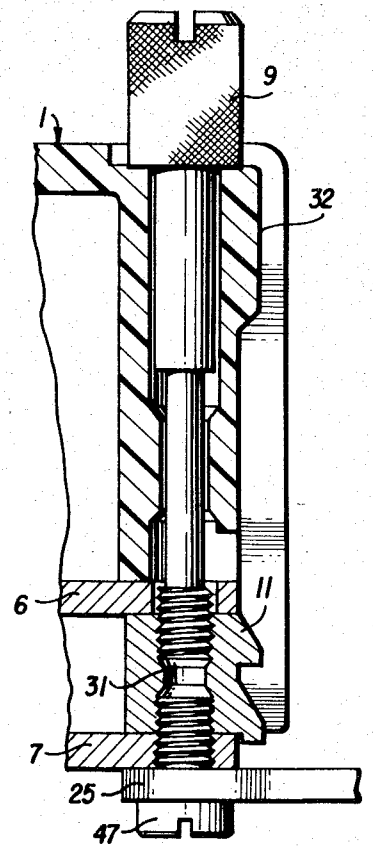
FIG. 3 shows a partial cross-section through the plug connection according to FIG. 1 in lengthwise direction.
Figure 2:
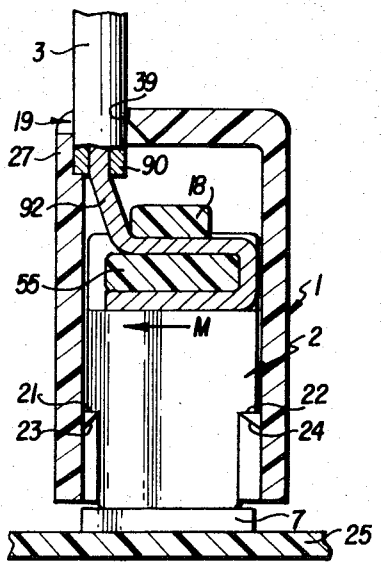
FIG. 2 shows a cross-section through the plug connection according to FIG. 1 in transverse direction.
Figure 1:
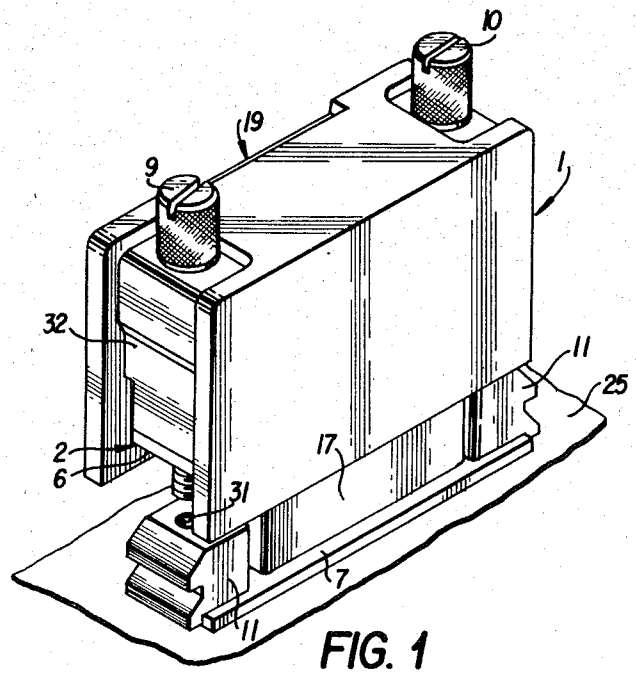
FIG. 1 shows a flat cable plug connection according to the prior art.

A plug connection is shown in FIGS. 1 to 3, as is described in German Patent application No. P 30 41 938.6 of Nov. 6, 1980.

In FIGS. 1 to 3, a plug connector 2 is shown surrounded by a housing 1, which can be inserted onto a counter plug connector 17. The counter plug connector 17 is fastened on a mechanism 25, for example a front or mounting plate. In FIG. 1, the plug connector 2 surrounded by housing 1 is not yet inserted onto counter plug 17. On the other hand, in both representations according to FIGS. 2 and 3, plug connector 2 and counter plug connector 17 are coupled. It will further be recognized especially in FIG. 1, that the counter plug connector 17 has a flange 7, which is fastened on the front plate in the manner shown in FIG. 3. On both plug connector narrow sides, screws 47 run through the ont plate 25 and the flange 7 into a threaded hole 31 of two blocks 11, one of which is actually arranged neighboring to each of the narrow sides of the counter plug connector 17.

By means of two knurled head screws 9 and 10, housing 1 can be fastened to the blocks 11 together with the plug connector 2 located in it, by screwing knurled head screws 9, 10 into the threaded holes 31. The knurled head screws 9 and 10 run through the flange 6 of the plug connection 2, before they are screwed with the blocks 11.

It is especially recognized in FIG. 2 that the inside of the housing 1 exhibits diametrically opposite-lying latches 23, 24, which mesh with the corresponding notched shoulders 21, 22 of the plug connection 2, in order in this way to hold housing 1 on the plug connection 2 and plug connection 2 in housing 1. Details with regard to this are disclosed in the aforementioned German patent application.

Housing 1 has a cable opening 19, through which a flat cable 3 is conducted into the housing interior, in order to be brought into connection with plug connector 2. For this purpose, cable core 92 runs around a tension release mechanism 18 in the form of a tension release clamp and is connected by a cable holder 55 according to the type of an insulation-free cutting clamp connection.

The flat cable 3 shown in FIG. 2 has no shielding. However, shielded flat cables are known, and in general there are three designs. In a first design, a metal plait is embedded in the flat cable insulation, i.e., in the cable core, on one side, which is connected with one or even with two edge wires of the flat cable. Over these edge wires, the cable shielding can be contacted. The processing of such flat cable is admittedly quite difficult and requires expensive equipment. In a second design, a metal foil is clamped in a loosenable manner on the flat cable insulation, that is to say on the cable core. Between the cable and the foil lies a supplementary ground wire permitting contacting of the shield. In a third design, the flat cable insulation or the cable core 92 (see FIG. 7) is surrounded completely by a metal foil (shield) 91, whereby there is a plastic casing 90 over the metal foil 91. Usually, there are supplementary ground wires between the cable core 92 and the metal foil 91 for contacting the shield.

Generally, flat cables are connected to plug connections by the technique of insulation-free cutting clamp connections. If the shielding additional ground wire should be likewise contacted according to this technique, at least one plug connection contact must be reserved for this. In the case of the mentioned flat cable types according to the first and second designs, a considerable amount of time is necessary for connecting the supplementary ground wire.

The plug connections available for the flat cable according to all three of the above designs allow only one shielding contact by means of the supplementary ground wire.

The present invention especially provides possibilities for avoiding the disadvantages of the state of the art in the case of flat cables of the third design described above.

The present invention takes into account two aspects. On the one hand, the invention has the intention of assuring a large surface connection of the cable shielding 91. On the other hand, radiations into and from the transition area between the plug connection 2 and the counter plug connection 17 should be avoided by the measures according to the invention. In particular, including the housing 1 consisting of metal or metallized plastic in the shielding system should be provided by the measures according to the invention.

According to the first aspect of the invention (FIGS. 4 to 8), a shielding connecting element (protective piece of sheet metal) consisting of metal sheet 80 is brought into contact with the large surface cable shielding 91, for example, by inserting between the cable shielding 91 and the cable core 92. The other end of the shielding connecting element 80 then is placed in direct contact either with the housing inside wall (FIG. 4) or the front plate 25 (FIG. 8). According to the second aspect of the invention, a shell-like screening piece of sheet metal (screening shell) 70 is provided in the area of the transition between the plug connection 2 and the counter plug connection 17 (see FIGS. 4, 5 and 6).

Figure 4:
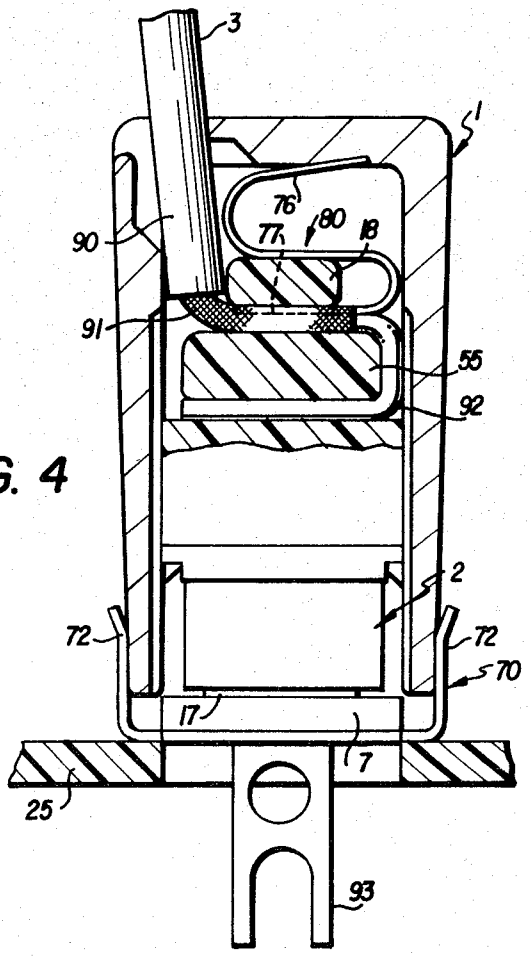
FIG. 4 shows a first embodiment of the invention in a sectional view similar to FIG. 2.

FIG. 4 shows a plug connection 2, which aside from the following differences shows a design according to FIGS. 1 to 3. This plug connection 2 is inserted in a counter plug connection 17, which is fastened with its flange 7 on a mounting plate 25. A shielding shell 70 is fastened between the flange 7 and the mounting plate 25 for example by the clamping effect between flange 7 and mounting plate 25. The shielding shell 70 has two short, spring-loaded lengthwise walls 72 which extend upward, as well as two, preferably somewhat longer (see FIG. 6), upward extending transverse walls 71. The walls 71, 72 are preferably yielding in a springloaded manner, so that with the inserting of the plug connection 2 into the counter plug connector 17, there is a good contacting between the walls 71, 72 and thus the interacting outside of the housing 1. In order to improve the spring effect, slots are provided at the transitions from walls 71 to walls 72. Preferably, the shielding shell 70 is formed of metal, but it can also consist of metallized plastic. The shielding shell 70 guarantees the shielding in the transition area between the plug connector 1 and the counter plug connector 17.

Furthermore, according to the invention, a shielding connecting element is provided in the shape of an S-shaped elastic metal sheet or shielding piece of sheet metal 80. The shielding piece of sheet metal has approximately the width of the flat cable 3 and is brought into large surface contact with the cable shielding 91. Preferably, in the way shown in FIG. 7, the shielding piece of sheet metal 80 is inserted with its one end between the cable shielding 91 and the cable core 92. By means of the stress relief mechanism 18, furthermore, a sufficient compressive force can be exerted on the cable shielding 91 and the inserted piece of shielding sheet metal 80, so that a good contact effect results. The shielding piece of sheet metal 80—bent into an S-shape preferably to improve the spring effect—is in contact with its other or second end, likewise large surface, with the inner wall of housing 1. Another reason for the S-shape is as follows:

The cable shielding 91 is pressed onto the stress relief clamp 18. A yielding of the cable insulation 92 does not have a negative effect on the shielding 91-shielding piece of sheet metal 80 connection. For example this would not be the case with a U-shaped piece of sheet metal. Since the housing 1 consists of metal or metallic plastic, the entire housing 1 is brought into the shielding effect. In the case of the embodiment according to FIG. 4, the connection of the shielding piece of sheet metal 80 with the ground or reference potential takes place over the housing 1 to shielding shell 70. The shielding shell 70 has a connecting lug 93.

Figure 5:
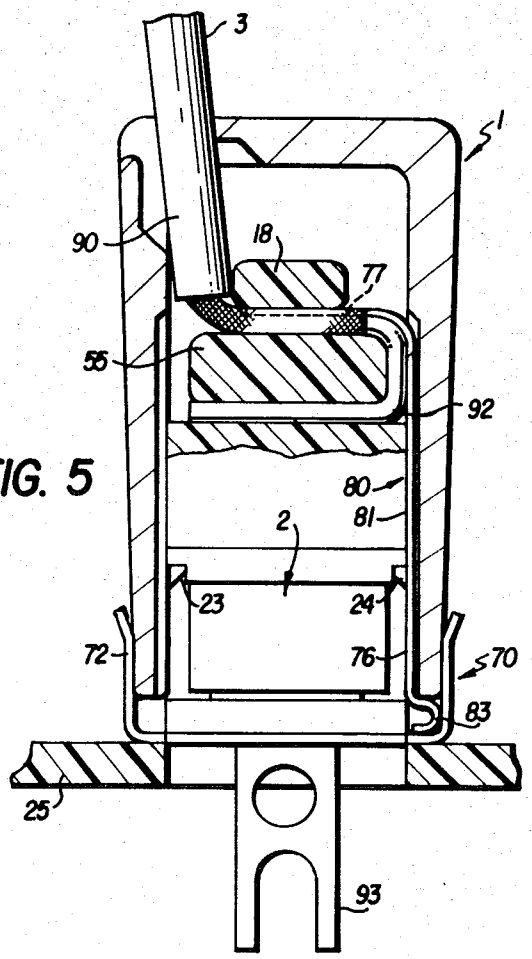
FIG. 5 shows a second embodiment in a cross-sectional representation similar to FIG. 2.
Figure 7:
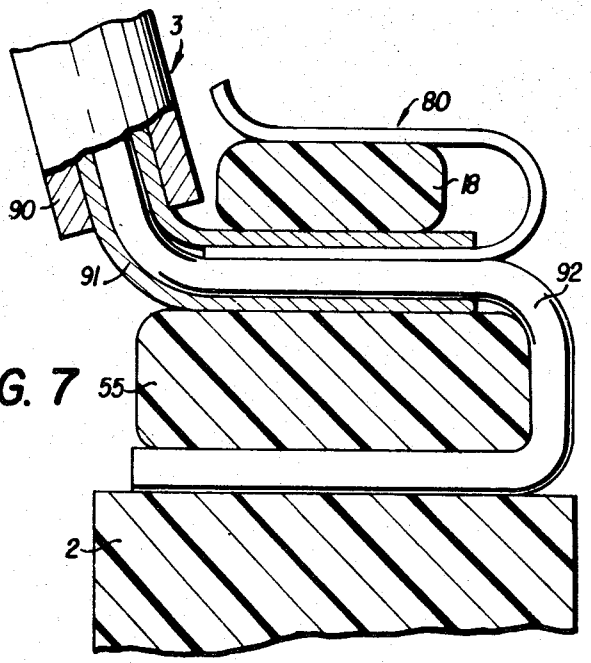
FIG. 7 shows a detail of the plug connection according to FIG. 4.
Figure 6:
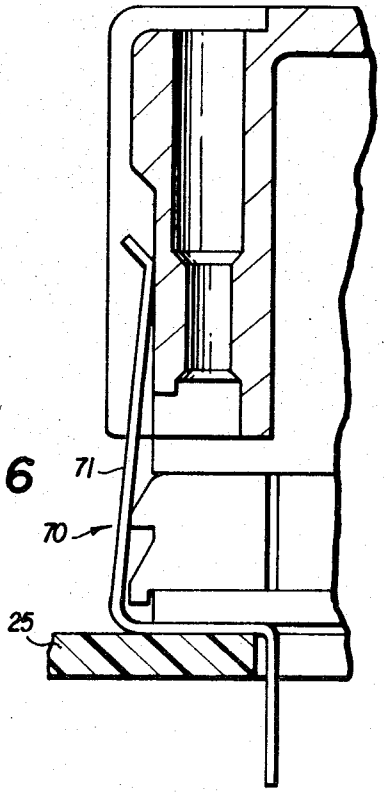
FIG. 6 shows a partial cross-section similar to FIG. 3 of the plug connection of FIGS. 4 and 5.

In the case of the embodiment shown in FIG. 5, the shielding connecting element is designed in the form of a piece of shielding sheet metal 81, which with its first end is contacted with the cable shielding 91 in the way and manner shown in FIG. 7. The shielding piece of sheet metal 81 in turn has a width approximately corresponding to the width of flat cable 3 and runs downward along one inner side of housing 1, in order to terminate in an approximately U-shaped spring part 83. The spring part 83 is in contact with one wall 72 of the already described shielding shell 70. After the shielding piece of sheet metal 81 also comes into contact with the inside of housing 1 (right side of FIG. 5), the housing 1 in turn can be included in the shielding system.

FIG. 8 shows another embodiment of the invention, in which the shielding piece of sheet metal 80 with its second end makes direct contact with mounting plate 25, without a shielding shell 70 or a plug connection housing 1 being indirectly needed. Here, however, the shielding piece of sheet metal 80 having approximately the width of the flat cable is in contact with the inside wall of housing 1 and especially with the one lower transverse edge of the housing 1, in order to include the housing 1 in the shielding system. The lower end of the shielding piece of sheet metal 80 is designed in U-shape in order to improve the spring effect and contacting. The opposite lying or first end of the shielding piece of sheet metal is fastened as shown in FIG. 7. In all the design examples, the shielding piece of sheet metal 80 lies in the housing middle, whereby the latches 23, 24 are mounted laterally. In the case of this embodiment, a shielding shell is not provided. Naturally, the leakage or radiation zones remain free on the two narrow sides and the one lengthwise side.

By means of the measures according to the invention, a complete shielding is achieved between the cable and mechanism 25 especially with the use of a shielding shell 70, and indeed with lower costs and simple assembly.

With respect to the embodiment of FIGS. 9 and 10, although this form of the invention includes a plug for a round cable 30 provided with cable shielding 95, as far as possible the same reference numerals are used as in the case of the previous design examples. It is recognized that the plug connection 2 surrounded by housing 1 is not yet inserted on the counter plug connection 17 in the drawing depiction of FIGS. 9 and 10, where this plug connection is mounted on the front or mounting plate 25. In the depicted embodiment, a printed circuit board 96 is connected to the counter plug connection 17. The round cable 30 is connected with the plug connection 2 over conductors 97.

According to the invention, a shielding connecting element 85 is provided which forms a one-piece shielding connecting part 87 connected with the shielding 95 of the cable, and exhibits a housing part 86. A housing contact part 86 is preferably designed in a spring-loaded manner so that it establishes a good electrical contact on the inner wall(s) of the housing 1. Preferably, the housing contact 86 is equipped with spring arms **86*a*, where preferably at least two spring arms 86*a* are diametrically opposite, and are arranged with respect to each other in such a way that they are in electrical contact with the opposite lying inside walls of housing 1**.

The shielding connecting element 85 is equipped with an anchoring 88, which preferably extends from housing contact part 86 and is to be arranged in a suitable recess 84 of the inner wall of housing 1. A twisting and a shifting of the shielding connecting element 85 is prevented in this manner. The recesses 84 are provided double, in order to thus make possible the different connecting methods for round cable 30 shown in FIG. 9.

The spring arms **86*a* preferably have shell-formed contact ends, which are in electrical contact by their convex outer sides with the inner walls of housing 1**.

The path provided between the cable shielding 95 and the reference or ground potential runs over the spring arms **86*a* of the housing contact part 86 and then over the housing 1 and from there over a shielding connecting piece of sheet metal 98, a soldering connection 99 to the ground or reference potential provided in printed circuit board 96. The counter plug connection 17 is screwed and soldered to the printed circuit board 96. A shielding connecting piece of sheet metal 98 is clamped between the flange 7 of the counter plug connector 17 and the front plate 25, whereby teeth of the shielding connecting piece of sheet metal or teeth of an additional element provided between the shielding connecting piece of sheet metal 98 and the front plate 25 engage in the latter and thus provide a good final connection even with an anodized or isolated front plate. Also, the shielding connecting piece of sheet metal 98 can selectively be provided with a soldering lug 100. The shielding connecting piece of sheet metal 98 has upward jutting contact springs 101 arranged around the entire circumference of the flange 7 of the counter plug connection 17, which when the plug connector is inserted 2 establishes a low-ohmic connection between the housing lower edge 102 and the shielding connecting piece of sheet metal 98**.

To connect the shielding connecting element 85 to the round cable 30, first the shielding plaiting of the cable 30 is exposed, brushed out and pushed back over the sheathing. Then by means of O-crimping, the shielding connecting part 87 is connected with the above-lying cable shielding 95. The cable shielding 95 is contacted over its full circumference. Then the cable fitting can be inserted into the housing 1 without the use of additional fastening elements. After closing the housing, consisting of two half shells, the spring arms **86*a* establishes electrical connection of the cable shielding 95** with both housing half shells.

The invention brings about a stress relief and shield contacting without the use of screws. The direct contacting of both housing halves improves the shielding effect. The result is then a clean design, since unused screw holes in the housing walls are dispensed with.

Another advantage of the invention consists in the fact that the shielding connecting piece of sheet metal 98 can be soldered directly with the printed circuit board 96. As already mentioned, there is a good contacting of the front plate 25 through the shielding connecting sheet metal 98 by the use of elements resembling teeth of a ratchet wheel which can form part of the shielding connecting piece of sheet metal 98. These teeth engage in depressions of the plug connector fastening bore holes, that is to say at places where the varnish or the anodized coating is interrupted.

In the case of the soldering connection 99 already mentioned, preferably this is a reference potential-connecting element in the form of a piece of sheet metal, which is designed in one piece with the shielding connecting piece of sheet metal 98 and is stamped out of this.

Although not shown in the drawing, the shielding shell 70 can also exhibit a reference potential-connecting element 99 in the form of a stamped out sheet metal part.

The reference potential-connecting element 99 is worked out of the shielding shell 70 and the shielding connecting piece of sheet metal in such a way that together with the connecting pin (not shown) of the plug connection 17, it can be contacted with the printed circuit board 96, and preferably can be soldered in.

We claim:

1. A plug connector for a flat cable including a shield, said connector comprising a housing, said housing being formed of a metal or a metallized plastic;

an opening in said houisng;

one end of said flat cable extending through said opening for electrical connection within said housing, said flat cable comprising a cable core of a plurality of parallel wires surrounded by cable shielding; and a shielded connecting element mounted within said housing, said element being preformed into a general S-shape cross-section and being formed of elastic sheet metal, one end of said element being in contact with an inner surface of said housing, and an opposite end of said element being inserted between said shielding and said core of said flat cable and being in electrical contact with said shielding, the width of said opposite end of said element being approximately the same as said flat cable, said element being spring loaded so as to contact said inner surface of said housing and said flat cable under spring tension, whereby said flat cable is grounded to said housing.

2. The connector of claim 1 including a shielding shell in contact with said housing, said shell being grounded, said shell having spring loaded side walls lying on the outside or the inside of said housing.

3. The connector of claim 1, including a tension relief mechanism mounted in said housing, an intermediate portion of said shielded connecting element being in contact with said tension relief mechanism, said tension relief mechanism firmly clamping said shield connecting element.

4. The connector of claim 3 including a shielding shell in contact with said housing, said shell being grounded.

5. The connector of claim 4 wherein said shielding shell comprises spring loaded side walls, said side walls lying on the outside or the inside of said housing.

6. A plug connector for a flat cable including a shield, said connector comprising a housing, said housing being formed of a metal or a metallized plastic;

an opening in said housing;

one end of said flat cable extending through said opening for electrical connection within said housing, said flat cable comprising a cable core of a plurality of parallel wires surrounded by cable shielding; and a shielded connecting element mounted within said housing, said element being preformed to a generally L-shape cross-section and being formed of elastic sheet metal, one end of said element being inserted between said shielding and said core of said flat cable and being in electrical contact with said shielding, the width of said one end of said element being approximately the same as said flat cable, an opposite end of said element being in electrical contact with a ground associated with a complementary connector adapted to be mated with said plug connector, said element being spring loaded so as to contact said ground and said flat cable under spring tension, whereby said flat cable is grounded.

7. The connector of claim 6 wherein said opposite end of said shielded connecting element terminates in an approximately U-shaped spring part.

8. The connector of claim 7 wherein said ground associated with said complementary connector comprises a shielding shell in contact with said housing, said shielding shell including spring loaded side walls lying on the outside or the inside of said housing.

9. A plug connector for a flat cable including a shield, said connector comprising a housing, said housing being formed of a metal or a metallized plastic;

an opening in said housing;

one end of said flat cable extending through said opening for electrical connection within said housing, said flat cable comprising a cable core of a plurality of parallel wires surrounded by cable shielding;

a shielded connecting element mounted within said housing, said element being preformed to a generally L-shape cross-section and being formed of elastic sheet metal, one end of said element being inserted between said shielding and said core of said flat cable and being in electrical contact with said shielding, the width of said one end of said element being approximately the same as said flat cable, a shielding shell in contact with said housing, said shell being grounded, said shell including spring loaded side walls lying on the outside or the inside of said housing; and an opposite end of said element being in electrical contact with said shielding shell, said element being spring loaded so as to contact said shielding shell and said flat cable under spring tension, whereby said flat cable is grounded.

10. The connector of claim 9 wherein said opposite end of said shielded connecting element terminates in an approximately U-shaped spring part.

* * * * *